US006332334B1

(12) United States Patent
Faryabi

(10) Patent No.: US 6,332,334 B1
(45) Date of Patent: Dec. 25, 2001

(54) METHOD AND APPARATUS FOR HANDLING AND TRANSPORTING TEMPERATURE-SENSITIVE ITEMS

(75) Inventor: Michael Faryabi, Danville, CA (US)

(73) Assignee: Webvan Group, Inc., Foster City, CA (US)

( * ) Notice: Subject to any disclaimer, the term of this patent is extended or adjusted under 35 U.S.C. 154(b) by 0 days.

(21) Appl. No.: 09/566,912

(22) Filed: May 9, 2000

Related U.S. Application Data

(60) Provisional application No. 60/133,314, filed on May 10, 1999.

(51) Int. Cl.[7] ..... F25D 3/08

(52) U.S. Cl. ..... 62/371; 62/372; 62/457.2

(58) Field of Search ..... 62/371, 372, 457.2, 62/457.7, 530; 220/495.03, 495.06

(56) References Cited

U.S. PATENT DOCUMENTS 2,781,643 * 2/1957 Fairweather .
3,406,532 * 10/1968 Rownd et al. .
4,213,310 * 7/1980 Buss .
5,105,627 * 4/1992 Kurita ..... 62/371 X
5,235,819 * 8/1993 Bruce ..... 62/457.2 X
5,533,361 * 7/1996 Halpern ..... 62/457.2
5,899,088 * 5/1999 Purdum ..... 62/371

* cited by examiner

*Primary Examiner*—Henry Bennett
*Assistant Examiner*—Chen-Wen Jiang
(74) *Attorney, Agent, or Firm*—Beyer Weaver & Thomas, LLP

(57) ABSTRACT

A container for handling and transporting temperature-sensitive items. The container includes a tote made of a resilient material, the tote including an opening for inserting items and flaps for covering the opening, wherein the tote has dimensions compatible with commercial product-handling equipment. The container further includes a liner sized to fit into the tote. In one embodiment, the liner includes a shell made of a resilient material and shaped to cover the interior surfaces of the tote. The liner has a layer of a temperature insulating material enclosed within the shell. A liner is lid sized to fit securely over the opening of the shell, and in one embodiment, includes a layer of the insulating material and a cavity for inserting a refrigerant material therein.

1 Claim, 9 Drawing Sheets

METHOD AND APPARATUS FOR HANDLING AND TRANSPORTING TEMPERATURE-SENSITIVE ITEMS

This application claims the benefit of U.S. Provisional Application No. 60/133,314 filed on May 10, 1999, the disclosure of which is incorporated herein by reference.

FIELD OF THE INVENTION

The invention is in the field of handling and transportation of temperature-sensitive items.

BACKGROUND

Storage and distribution of consumer goods, particularly perishable consumer goods, becomes an ever greater challenge as consumer products companies grow larger and span greater geographical areas. Large grocery chains, for example, may receive meat and produce from different locations, each many miles away, that must then be stored in a central warehouse facility and later trucked to points of sale far away from the warehouse facility. This situation poses extensive logistical problems, but also requires that foods such as frozen foods or fresh vegetables be handled and transported under controlled conditions to maintain their salability. In the case of a large grocery store chain, each type of item is typically shipped to a central warehouse in a specialized vehicle such as a refrigerated truck or a truck with freezer facilities. The problem of food handling is somewhat simplified when large quantities of foods with similar handling requirements can be shipped and stored in bulk together. Transporting food products having dissimilar handling requirements, such as an individual consumer order, still poses significant problems. One approach to the problem of keeping frozen foods cold, for example, involves lining a standard transportation container with a disposable liner made of a material such as Styrofoam. The use of Styrofoam has disadvantages. For example, the Styrofoam is not durable, so it is easily broken and must be frequently replaced. Styrofoam is not sanitary enough for reuse in transporting foods, even if it is not broken. Because Styrofoam is very porous, it traps contaminants and cannot be adequately cleaned because of its delicacy.

SUMMARY

A container for handling and transporting temperature-sensitive items is described. The container includes an exterior made of a resilient material. The exterior has attached flaps for completely covering a top opening. The closed dimensions of the container make the container compatible with commercial product-handling equipment. The container includes a liner that fits snugly into the exterior. The lining includes a shell made of a resilient material. When inserted in the exterior, the liner shell covers all of the interior surfaces of the container. The shell is filled with insulating material. The liner includes a lid sized to fit securely over the opening of the shell. The lid includes a layer of the insulating material and a compartment adjacent to the layer of insulating material such that the compartment faces the interior of the liner when the lid is in place. The compartment is accessible for the insertion of a refrigerant material. The lid, including the layer of insulating material and the compartment, is coated by a layer of resilient material.

DETAILED DESCRIPTION

As consumers become busier and have less and less time to do ordinary household tasks such as shopping for consumables, a need has arisen for a service industry to perform these tasks for the consumer. It has long been possible in some areas of the country, for example very large cities, for consumers to order groceries from a local store. The groceries are collected by hand at the store and delivered to the consumer. In this situation, the consumer is typically very close to the store, and special product handling measures are not required. This "neighborhood grocery" model is inadequate for extension to consumers on a very large scale, however. One of the disadvantages of the neighborhood grocery model is that a person is required to handpick groceries for the consumer and carry them to the consumer on an order-by-order basis.

A workable large scale model for a consumer grocery shopping services includes an easy accessible way for orders to be placed by the consumer, such as by computer over the Internet. In addition, a workable model includes a large warehouse facility for storing consumer items in the units the consumer would require from a grocery store. Once the customer order is entered, much of the item collection to fill the order is automated, and the order is distributed with many others via an efficient trucking route system. This grocery shopping service is extremely convenient for the consumer and still economical because the service provider is not obligated to pay the costs of grocery store personnel or multiple grocery store locations. Some challenges do exist, however, such as keeping various foods in a single consumer order under appropriate conditions so that they can be delivered in good condition to the consumer. In addition, multiple consumer orders, each including foods with various environmental requirements, must be carried together on a route. A consumer whose location in the route falls rather far away from the warehouse may order some nonperishable items, some fresh vegetable items, and some frozen items such as ice cream. This requires handling equipment and methods that allow the various products to be easily collected from the warehouse, easily kept together as a single order, and delivered in good condition to the consumer.

A container is described herein for handling and transporting groups of items that require temperature controlled environments. The groups of items may be of varying sizes. The container provides enhanced handling capability for temperature-sensitive items while allowing handling with typical commercial product-handling equipment.

Figure 1:
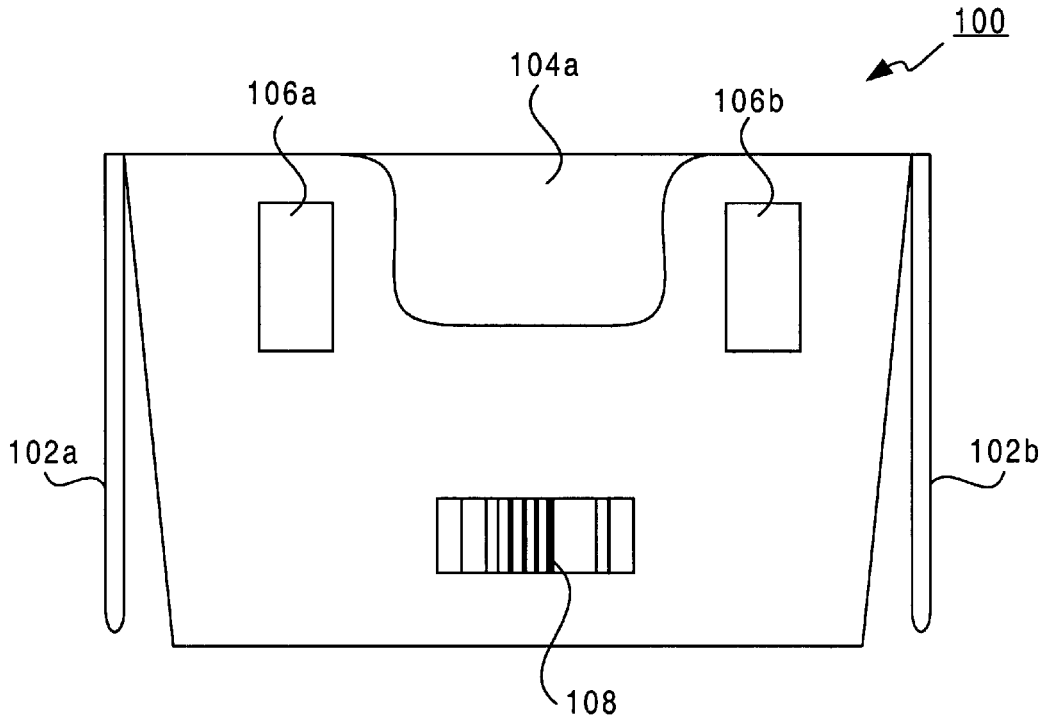
FIG. 1 is an end view of a large tote showing handle, lid and bar code.

FIG. 1 is an end view of a container, or tote, of one embodiment. Hereafter, "end" will be used to denote a shorter side of the rectangular tote, while "side" will be used to denote a longer side of the tote. Tote 100 has slightly tapered sides to allow stacking when flaps 102*a* and 102*b* are open. Tote 100 includes handle 104*a* which allows tote 100 to be picked up manually or by automated handling equipment. Pushpads 106*a* and 106*b* protrude from the end of tote 100 such that similar pushpads on a similar tote contact pushpads 106 when tote 100 is travelling along a conveyer belt with other, similar totes. Barcode 108 is attached to the end of tote 100 for identifying the tote or its contents.

Figure 2:
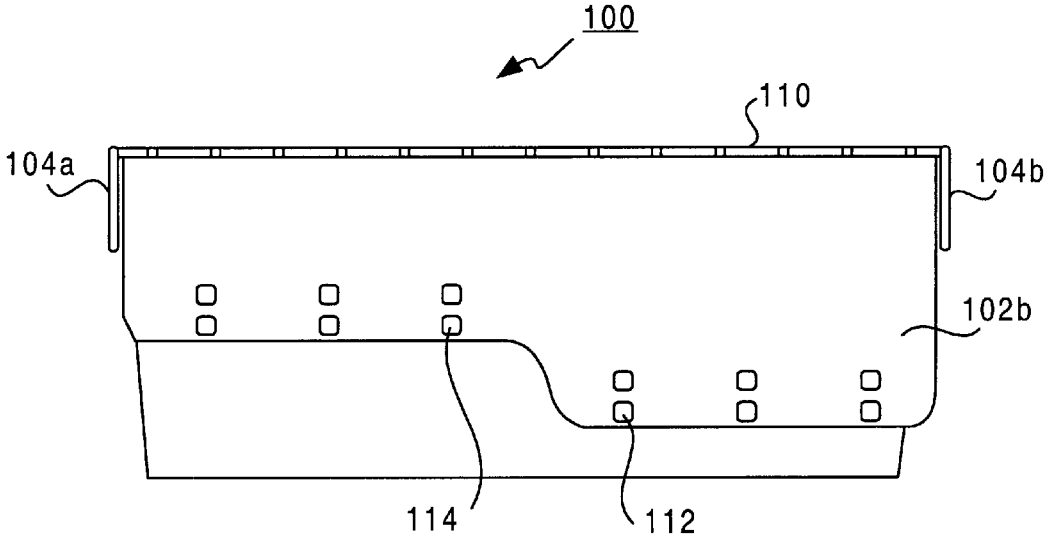
FIG. 2 is a side view of a large tote showing handles, hinged lid, and protrusions/depressions for closure.

FIG. 2 is a side view of tote 100 showing flap 102*b,* handles 104, and hinge 110. Protrusion 112 is one of six protruding areas shown. Depression 114 is one of six depressions shown. Protrusions 112 fit into depressions 114 on flap 102*b* and depressions 114 receive similar protrusions on flap 102*a* when flaps 102 in the closed position. This allows weight to be placed on flaps 102 without flaps 102 collapsing inward toward the contents of tote 100.

Tote 100 may come in various sizes. For example, for one embodiment of a product-handling system, tote 100 may come in two sizes, large and small. In one embodiment, large tote 100 has exterior bottom dimensions of 12⅛ inches to 12¼ inches by 18⅛ to 18¼ inches. Large tote 100 may have an exterior height of 12⅛ inches to 12¼ inches. Large tote 100 may have exterior top dimensions of 13⅞ inches to 14 inches by 19⅞ inches to 20 inches. In one embodiment, small tote 100 has exterior bottom dimensions of 7⅜ inches to 7 1/12 inches by 12¼ inches to 12⅜ inches. Small tote 100 may have an exterior height of 8¾ inches to 8⅞ inches. Small tote 100 may have exterior top dimensions of 8⅞ inches to 9 inches by 13⅝ inches to 13¾ inches. Tote 100 may be made out of any hard, yet resilient material such as a plastic. Tote 100 may be a commercially available container. For example, a tote such as tote 100 may be obtained from Orbis, Inc. of Oconomowoc, Wis.

Figure 3:
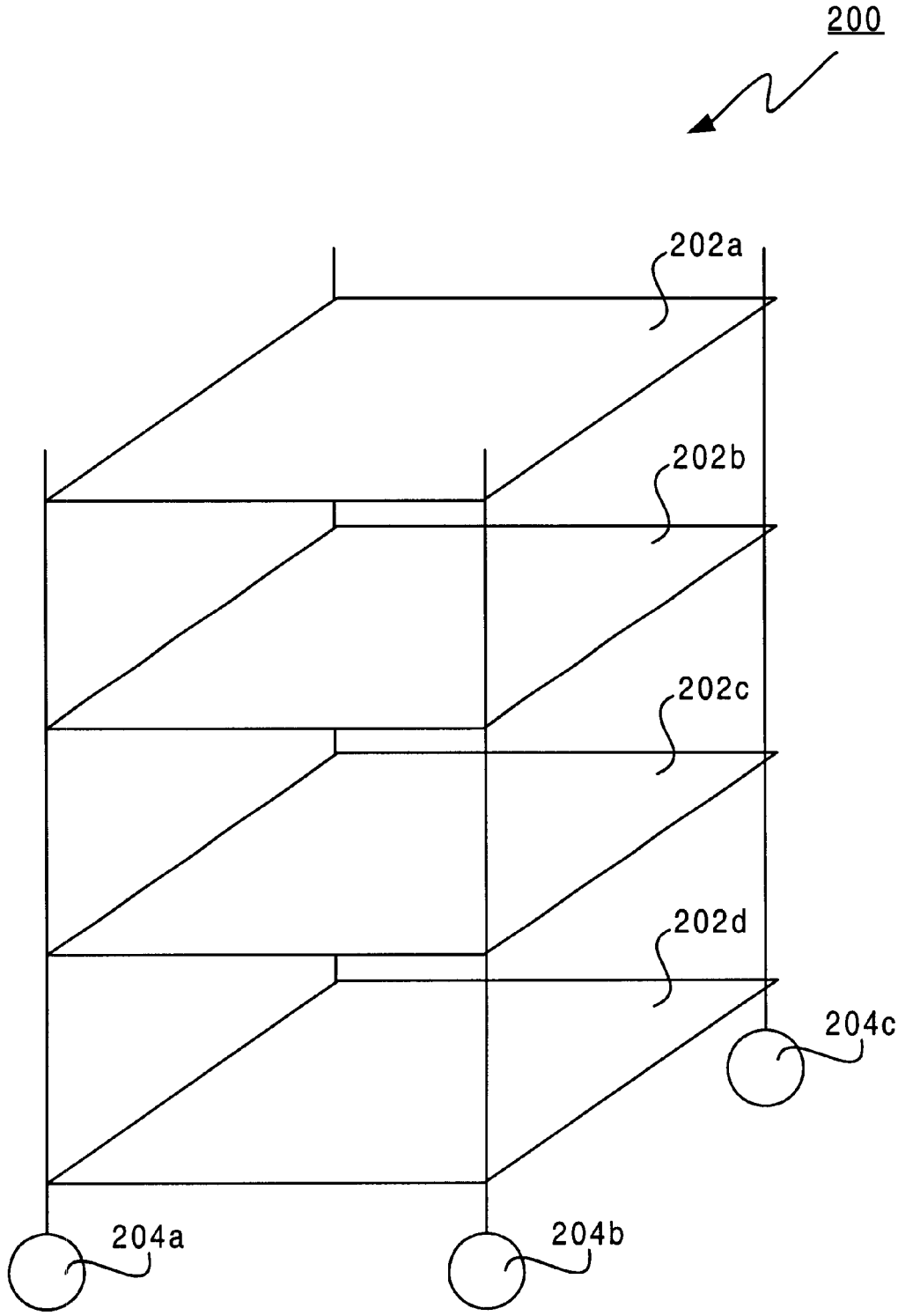
FIG. 3 is a diagram of a tote dolly.

FIG. 3 is a diagram of a cart, or dolly, usable with the totes described herein. Dolly 200 includes four shelves 202*a* through 202*d,* and four wheels 204. Shelves 202 are sized to contain exactly two large totes or four small totes.

Figure 4:
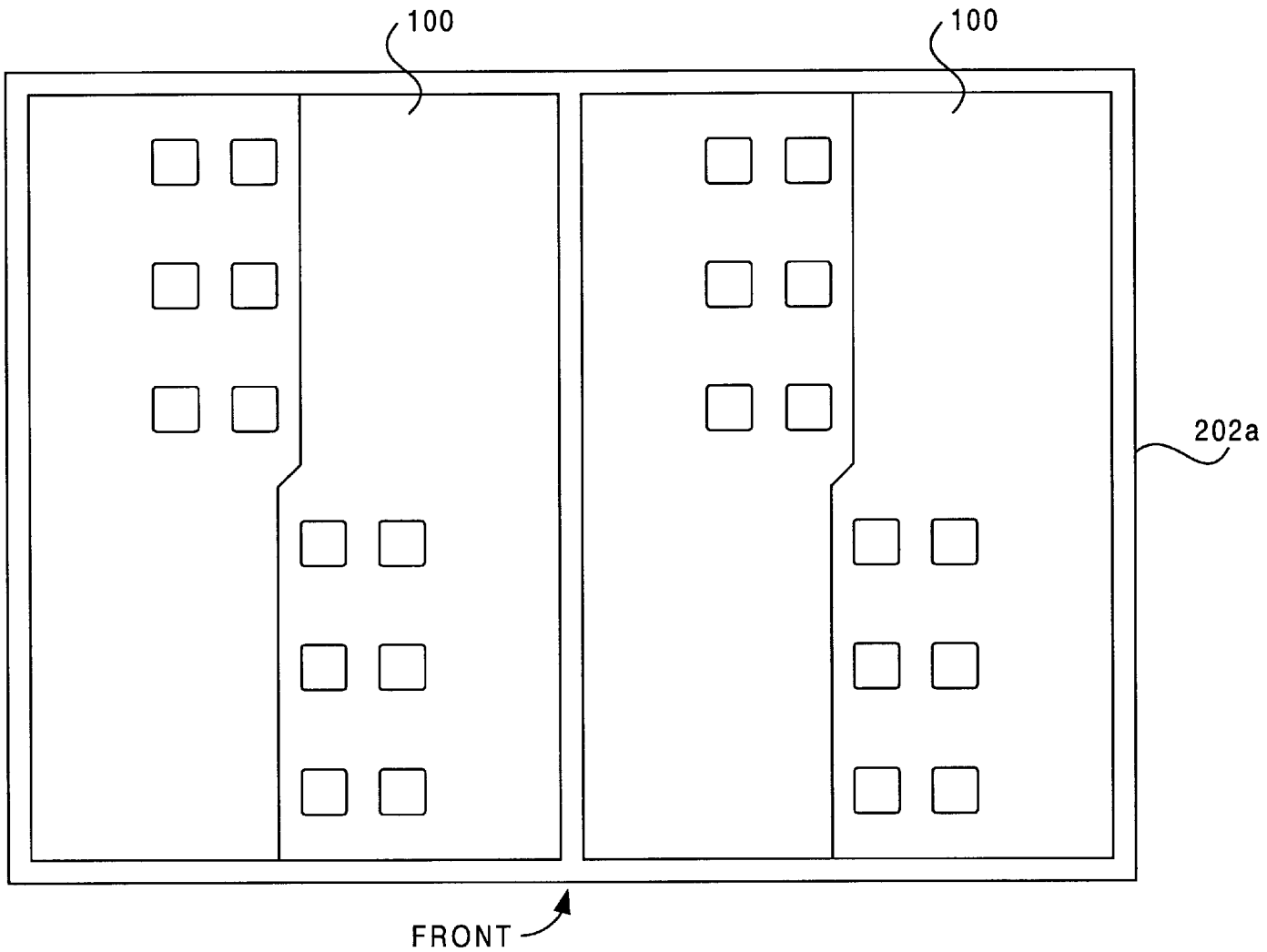
FIG. 4 is a top view of the tote dolly showing the top shelf loaded with two closed large totes.

FIG. 4 is a top view of shelf 202*a* including two large totes 100. The front of the dolly, as indicated, is the direction in which barcodes 108 face for easy scanning.

Figure 5:
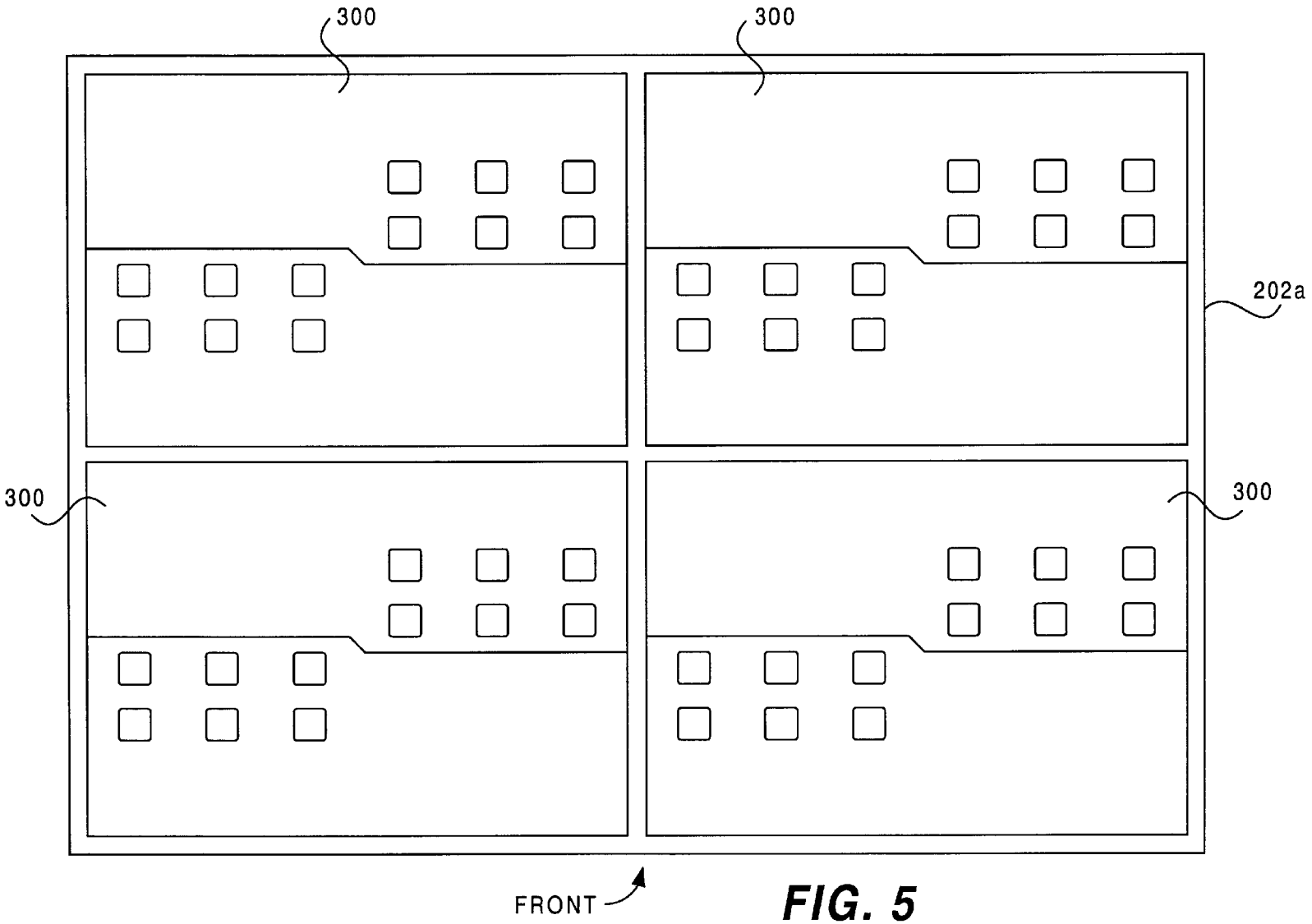
FIG. 5 is a top view of the tote dolly showing the top shelf loaded with four closed small totes.

FIG. 5 is a top view of shelf 202*a* with four small totes 300 resting thereon. As shown, four totes 300 may be placed on shelf 202*a,* and the sides of the totes 300 face the front of dolly 200. For this reason, barcodes 108 may be placed on the sides of small totes 300 as opposed to the ends of large totes 100. Totes 100 and 300 are also sized such that two totes 300 may be stacked on top of one tote 100.

Figure 6:
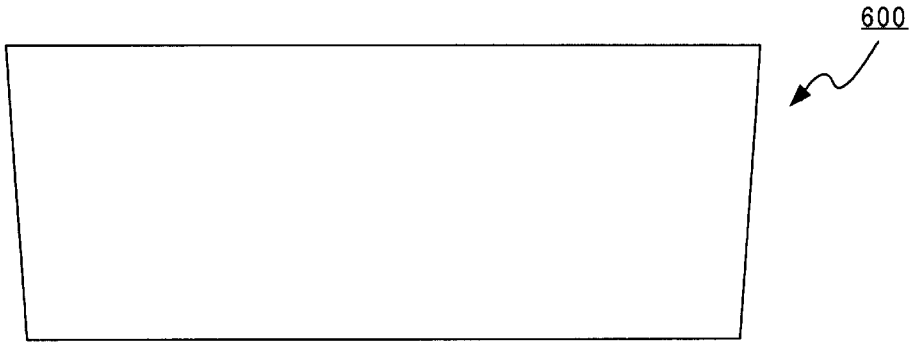
FIG. 6 is a side view of a large insulating tote insert with the lid in place.

FIG. 6 is a diagram of a liner having exterior dimensions substantially the same as the interior dimensions of tote 100. Liner 600 is essentially a shell that is filled with an insulating material such as polyurethane. The shell, in one embodiment, is made of polyethylene. When liner 600 is sized to fit into large tote 100, the thickness of the shell is approximately ½ inch to 1 inch. When liner 600 is sized to fit into the interior of small tote 300, the thickness of the shell is approximately ½ inch to ¾ inch. Liner 600 includes a lid that is assembled on liner 600 of FIG. 6 but is not visible in that view. Liner 600 with its lid assembled (as further described below) is sized to fit on tote 100 or tote 300 such that the tote may be completely closed without interference.

Liner 600 is strong enough to be reused many times and may be washed, for example, by steam cleaning for sanitization without degrading its performance. Liner 600 may be placed inside a tote 100 with or without a glue to hold it in place in the tote.

Figure 7:
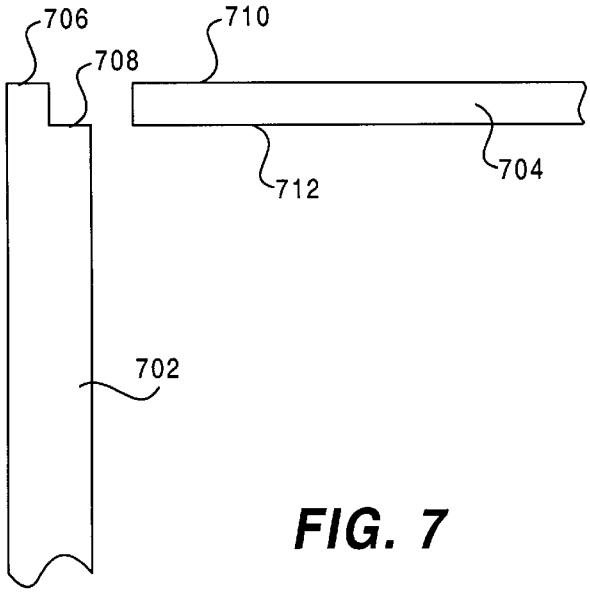
FIG. 7 shows part of a lid of one embodiment and a cross section view of a tote wall of the embodiment.

FIG. 7 shows part of one embodiment of a liner lid and a cross-section of a side of liner 600. Lid 704 includes upper surface 710 and lower surface 712. When assembled on liner 600, lower surface 712 sits on mating surface 708, and surface 710 is flush with surface 706. In one embodiment, a compressible gasket material covers mating surface 708. Alternatively, a gasket of compressible material may be attached to the mating surface of surface 712.

Figure 8:
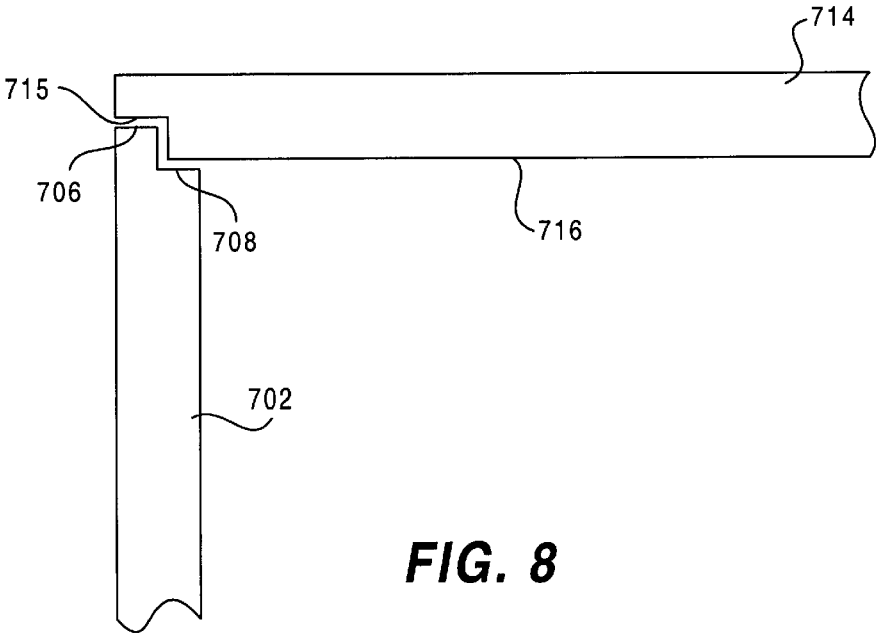
FIG. 8 shows part of a lid of another embodiment and a cross section view of a tote wall of the embodiment.

FIG. 8 is a diagram of another embodiment of a lid. Lid 714 includes lower surface 716 and lower surface 715. Lower surface 716 contacts mating surface 708 when lid 714 is assembled, and lower surface 715 contacts surface 706 when lid 714 is assembled. Either of surfaces 716 or 708 could includes compressible gaskets as described with reference to FIG. 7.

Figure 9A:
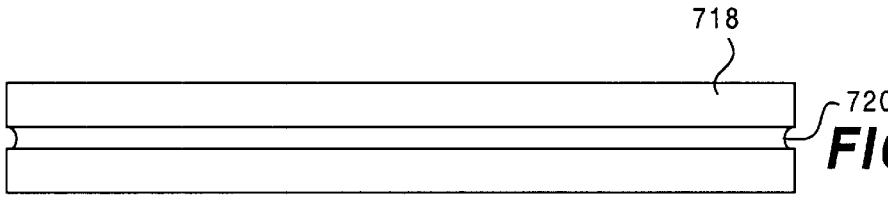
FIG. 9*a* is an end view of one embodiment of a lid including a groove for a gasket.
Figure 9B:
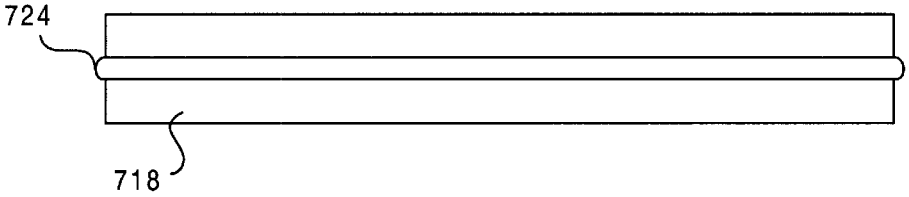
FIG. 9*b* is an end view of the lid of FIG. 9*b* with a round rubber gasket installed.

FIG. 9*a* is an end view of an embodiment of a lid 718 including a groove 720 around the circumference of the edge of lid 718. FIG. 9*b* shows lid 718 with a round rubber gasket 724 inserted in groove 720. Gasket 724 provides a tighter seal than the arrangement shown in either FIG. 7 or FIG. 8. Lid 718 is sized such that its upper surface is flush with upper surface 706 of the liner 600 when assembled.

Figure 10:
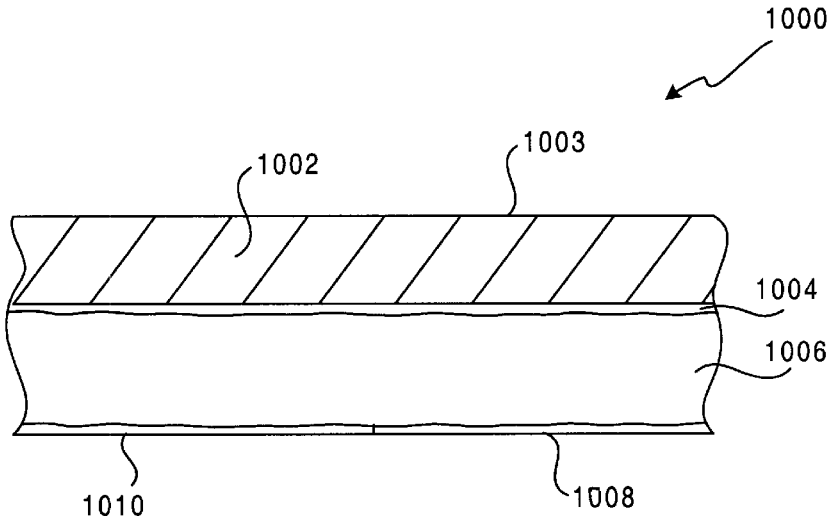
FIG. 10 is a cross section view of an embodiment of a lid including insulating material and gel refrigerant.

FIG. 10 is a cross-section view of one embodiment of a lid 1000. Lid 1000 has a top outer layer 1003 made of polyethylene. Insulating material 1002, in one embodiment, is rigid polyurethane. Interface 1004 is the top surface of the rigid polyurethane layer 1002. Flaps 1008 and 1010 make up the bottom of lid 1000 when closed. Gel pack 1006 is shown inserted into the compartment created by interface 1004 and lower surface 1008/1010. Gel pack 1006 is a layer of frozen refrigerant, such as guar gum and salt solution, that has been previously frozen and sealed in a leakproof container such as a sealed plastic bag. Gels made of guar gum and salt solution may reach a temperature of −10° Fahrenheit. Over time the gel will return to a liquid form and lose its refrigerant properties until it is refrozen.

Figure 11:
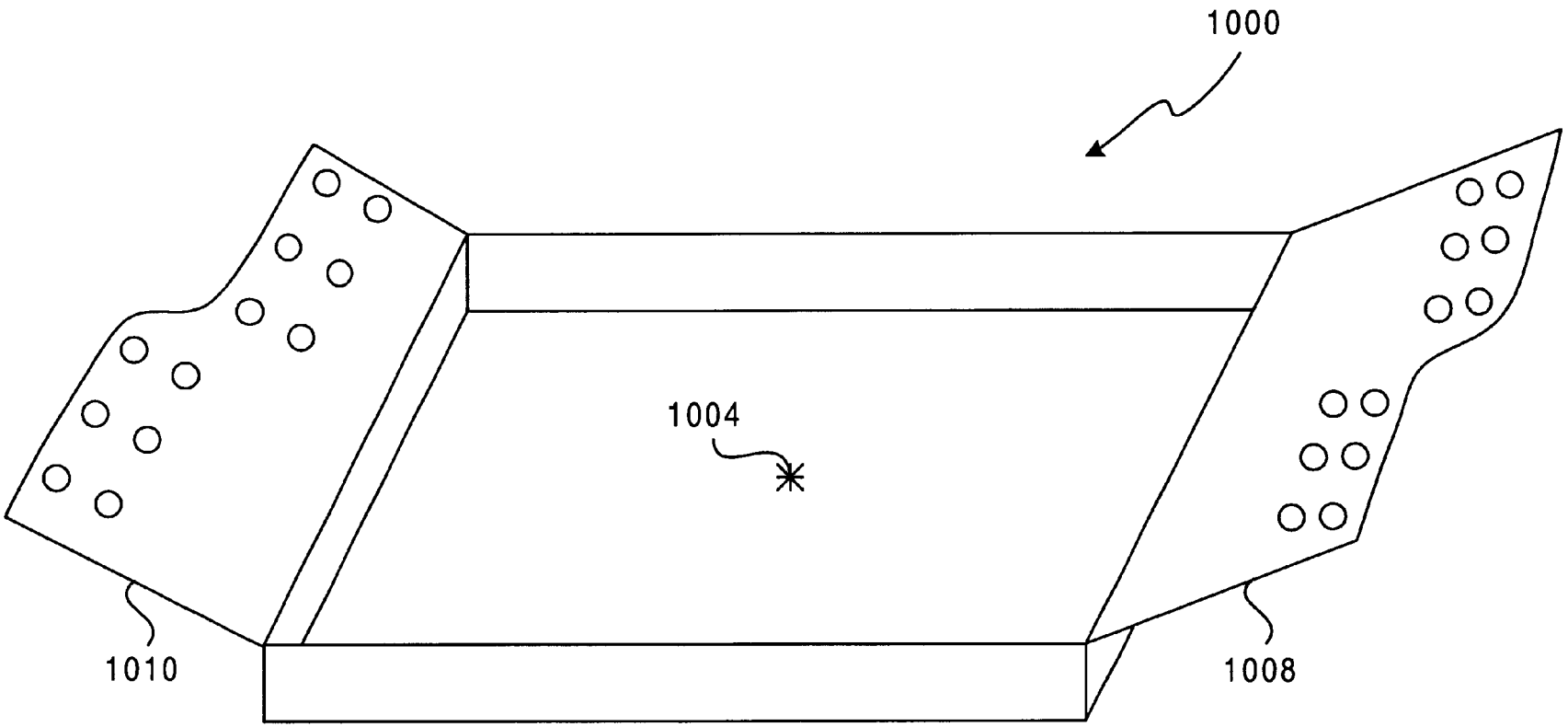
FIG. 11 is a view of the bottom of the lid of FIG. 10 showing hinged sections for allowing placement of the gel refrigerant.

FIG. 11 is a view of lid 1000 showing bottom flaps 1008 and 1010 in an open position. Flaps 1008 and 1010 interlock with depressions and protrusions as described with respect to tote 100. When flaps 1008 and 1010 are open, gel pack 1006 may be inserted. Other embodiments may open and close in different ways, for example, the entire bottom surface of lid 1000 may be hinged to open and close.

Figure 12:
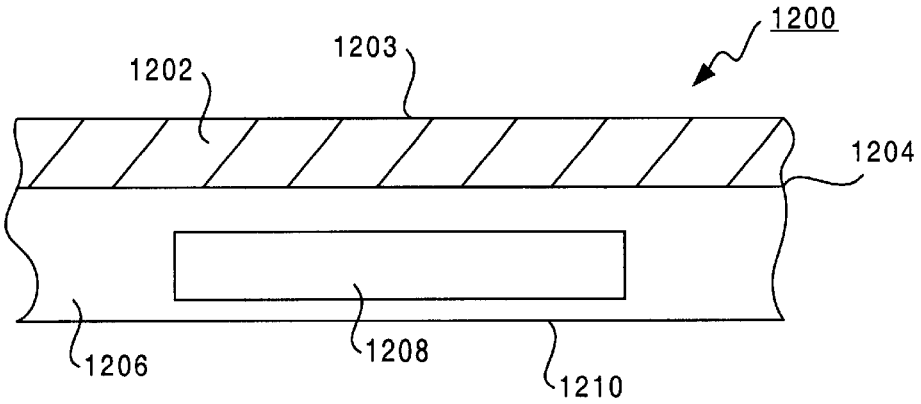
FIG. 12 is a cross section view of an embodiment of a lid including insulating material and dry ice in a compartment of the lid.

FIG. 12 is a cross-section view of another embodiment of a lid 1200. Lid 1200 has an upper surface 1203 and a lower surface 1210 that are thin layers of polyethylene. Insulating layer 1202 is made of rigid polyurethane or some other insulating material, and has an interface surface 1204. Compartment 1206 is a space between interface 1204 and lower surface 1210. A refrigerant, such as dry ice ($CO_2$), may be inserted into compartment 1206 1208. Dry ice changes state from gas to solid at a temperature of approximately −110° Fahrenheit. Therefore, dry ice is a more efficient refrigerant than a material such as the gel previously described. For this reason, it is not necessary to fill the entire compartment 1206 with dry ice.

Figure 13:
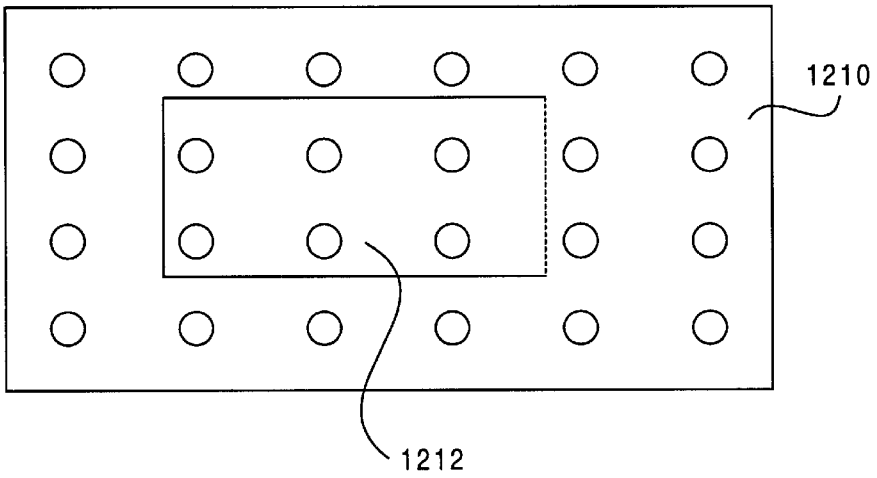
FIG. 13 shows the bottom of the lid of FIG. 12, including a door for inserting the dry ice and holes for allowing evaporating gas to escape the compartment.

FIG. 13 is a view of the bottom of lid 1200. Hinged door 1212 is for the insertion of dry ice block 1208. Lower surface 1210 is perforated as shown to provide holes for the escape of gas as dry ice block 1208 evaporates upon warming.

Figure 14:
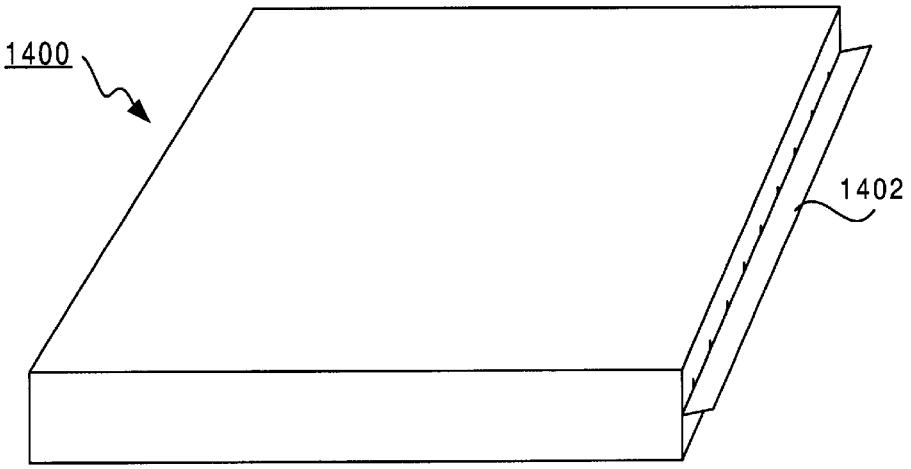
FIG. 14 is a view of an embodiment of a lid including a door on a side for allowing the insertion of refrigerant material.

FIG. 14 is a diagram of a lid 1400 showing an alternate hinged edge door 1402 that could be used to insert either a gel pack as shown in FIG. 10, or a dry ice block as shown in FIG. 12.

Another embodiment includes a liner as described with a lid that is made of a porous foam. The porous foam is compressible and can be pressed into the liner as far as required to cover the contents of the liner and exclude most air space above the contents. Dry ice or some other refrigerant may be added to the contents of the container. The foam is porous enough to allow evaporating gas to escape the container.

Figure 15A:
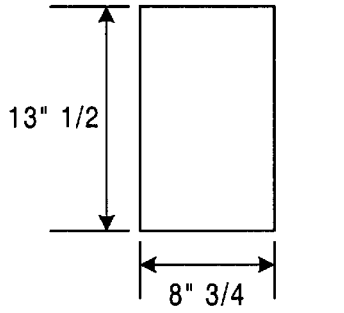
FIGS. 15*a*–15*c* show the interior dimensions of one embodiment of a small tote.
Figure 15B:
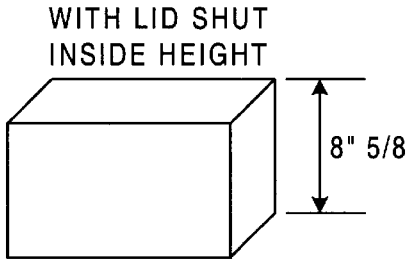
Figure 15C:
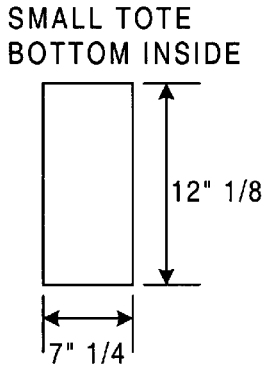

FIGS. 15*a,* 15*b,* and 15*c* show inside tote dimensions of a small tote 300 according to one embodiment. The inside dimensions represent the outside dimensions of a corresponding liner as described.

Figure 16A:
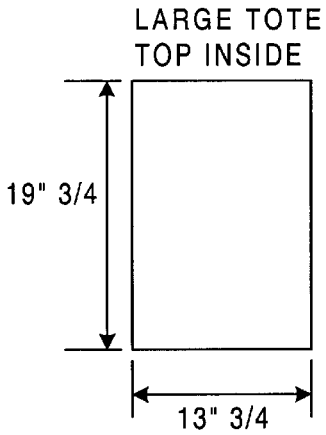
FIGS. 16*a*–16*c* show the interior dimensions of one embodiment of a large tote.
Figure 16B:
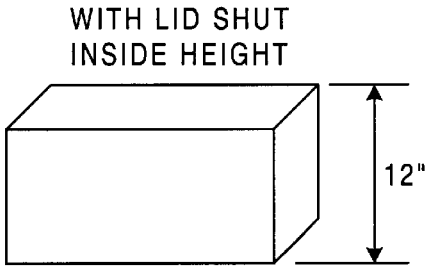
Figure 16C:
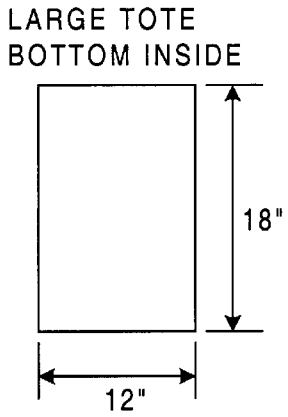

FIGS. 16*a,* 16*b,* and 16*c* show the inside dimensions of a large tote 100 according to one embodiment. The inside dimensions shown represent the outside dimensions of a corresponding insulating liner.

A container for handling and transporting temperature-sensitive items has been described with reference to particular embodiments. Other embodiments are within the spirit and scope of the invention. For example, the container may be used to keep hot items warm rather to keep cold items cold, in which case, refrigerants would not be used in the lid. Different insulating materials or cooling materials than those described herein could also be used. A system is also envisioned in which the container includes a liner as described and dry ice in the lid as described, but is further pressurized such that the dry ice maintains its solid state and provides cooling for a much longer period, until the container is depressurized. The container has been described as for use in transporting food items. It is within the spirit and scope of the invention, however, to use the container described herein for transporting biological or industrial materials.

What is claimed is:

1. A container for handling and transporting temperature-sensitive items, comprising:

a tote made of a resilient material, the tote including an opening for inserting items and flaps for covering the opening, wherein the tote has dimensions compatible with commercial product-handling equipment; and a liner sized to fit into the tote, the liner comprising:

a shell made of a resilient material and shaped to cover the interior surfaces of the tote and having an opening coincident with the opening of the tote;

a layer of a temperature insulating material, the insulating layer enclosed within the shell; and a lid sized to fit securely over the opening of the shell such that the flaps close over the lid and the shell without interference, the lid comprising:

a layer of the insulating material; and a compartment adjacent to the layer of the insulating material such that the compartment faces the interior of the liner when the lid is in place on the shell, wherein the compartment is accessible for the insertion of a refrigerant material, and wherein the layer of the insulating material and the compartment are coated by a layer of resilient material.

* * * * *